US006942130B1

(12) United States Patent
Duva

(10) Patent No.: US 6,942,130 B1
(45) Date of Patent: Sep. 13, 2005

(54) CARRIER DEVICE

(76) Inventor: Jack Duva, 19431 Olana La., Huntington Beach, CA (US) 92646

( * ) Notice: Subject to any disclaimer, the term of this patent is extended or adjusted under 35 U.S.C. 154(b) by 218 days.

(21) Appl. No.: 10/374,179

(22) Filed: Feb. 25, 2003

(51) Int. Cl.[7] ..... A45C 9/00; B60R 11/00

(52) U.S. Cl. ..... 224/407; 224/584; 224/676; 135/66

(58) Field of Search ..... 224/576–578, 224/584, 676–677, 680–684, 401, 407, 409, 224/411, 924, 585, 580, 660; 135/66, 67

(56) References Cited

U.S. PATENT DOCUMENTS

| | | | | | |
|---|---|---|---|---|---|
| 4,515,300 | A | * | 5/1985 | Cohen | 224/153 |
| 4,545,414 | A | * | 10/1985 | Baum | 224/580 |
| 4,974,760 | A | | 12/1990 | Miller | |
| D346,489 | S | * | 5/1994 | Bean et al. | D7/709 |
| 5,370,246 | A | | 12/1994 | Traynor | |
| 5,407,111 | A | * | 4/1995 | Lanouette et al. | 224/579 |
| 5,513,789 | A | | 5/1996 | Woods et al. | |
| D371,905 | S | * | 7/1996 | Kopel | D3/226 |
| 5,771,305 | A | * | 6/1998 | Davis | 224/413 |
| 5,803,333 | A | * | 9/1998 | Fawcett | 224/652 |
| D403,926 | S | * | 1/1999 | Sutton | D7/607 |
| D411,659 | S | * | 6/1999 | Karton | D3/226 |
| 5,941,437 | A | * | 8/1999 | Okumura | 224/585 |
| 6,109,496 | A | * | 8/2000 | Andrew et al. | 224/676 |
| 6,634,531 | B2 | * | 10/2003 | Conte | 224/407 |
| 6,766,930 | B2 | * | 7/2004 | Dixon et al. | 224/409 |

* cited by examiner

*Primary Examiner*—Nathan J. Newhouse

(57) ABSTRACT

A the carrier device for providing safety by carrying items for a person using a walker. The the carrier device includes a strap member being designed for being selectively coupled to the walker. The strap member is designed for being positioned around a user when the strap member is removed from the walker. A receiving assembly is coupled to the strap member whereby the strap member is designed for coupling the receiving assembly to the walker. The receiving assembly is designed for receiving objects to be carried for the user whereby the receiving assembly is for allowing the hands of the user to be used on the walker to enhance the safety of the user using the walker.

15 Claims, 4 Drawing Sheets

CARRIER DEVICE

BACKGROUND OF THE INVENTION

1. Field of the Invention

The present invention relates to storage caddies and more particularly pertains to a new the carrier device for providing safety by carrying items for a person using a walker.

2. Description of the Prior Art

The use of storage caddies is known in the prior art. U.S. Pat. No. 5,370,246 describes a device for being coupled to the bed of a patient for storing items for the patient. Another type of storage caddy is U.S. Pat. No. 4,974,760 having an article carrier that is coupled to a walker for carrying article for a user using the walker. U.S. Pat. No. 5,513,789 has a plurality of fabric accessories coupled to a walker to enhance the usefulness of the walker to the user.

SUMMARY OF THE INVENTION

Still yet another object of the present invention is to provide a new the carrier device that permits a user to carry objects on the walker and provides a safer environment by leaving the hands of the user free to stabilize themselves on the walker.

Even still another object of the present invention is to provide a new the carrier device that has a plurality of securing straps that engage a support bar of the walker and inhibit shifting of the container member.

To this end, the present invention generally comprises a strap member being designed for being selectively coupled to the walker. The strap member is designed for being positioned around a user when the strap member is removed from the walker. A receiving assembly is coupled to the strap member whereby the strap member is designed for coupling the receiving assembly to the walker. The receiving assembly is designed for receiving objects to be carried for the user whereby the receiving assembly is for allowing the hands of the user to be used on the walker to enhance the safety of the user using the walker.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
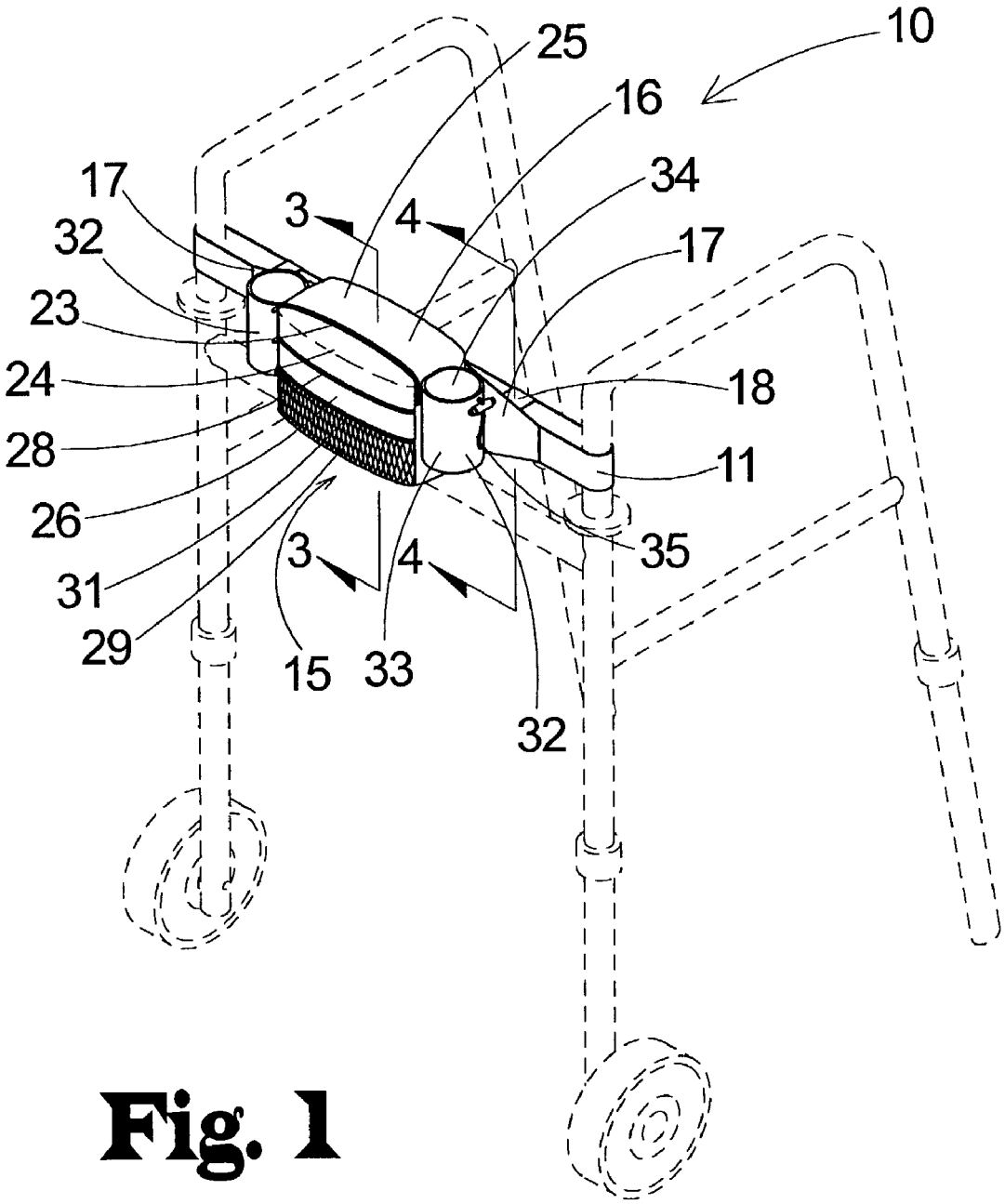
FIG. 1 is a perspective view of a new the carrier device according to the present invention shown in use.
Figure 2:
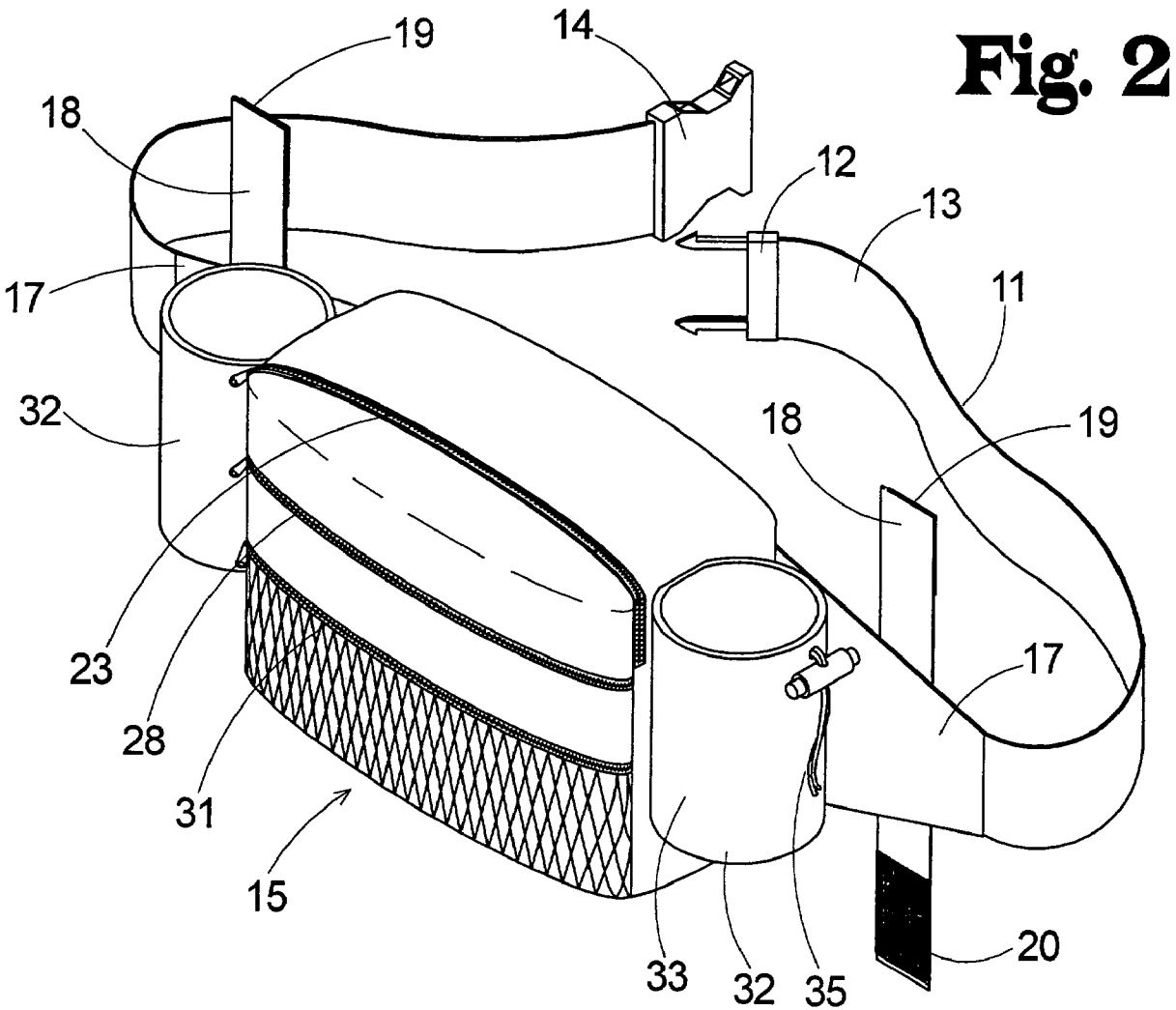
FIG. 2 is a perspective view of the present invention.
Figure 3:
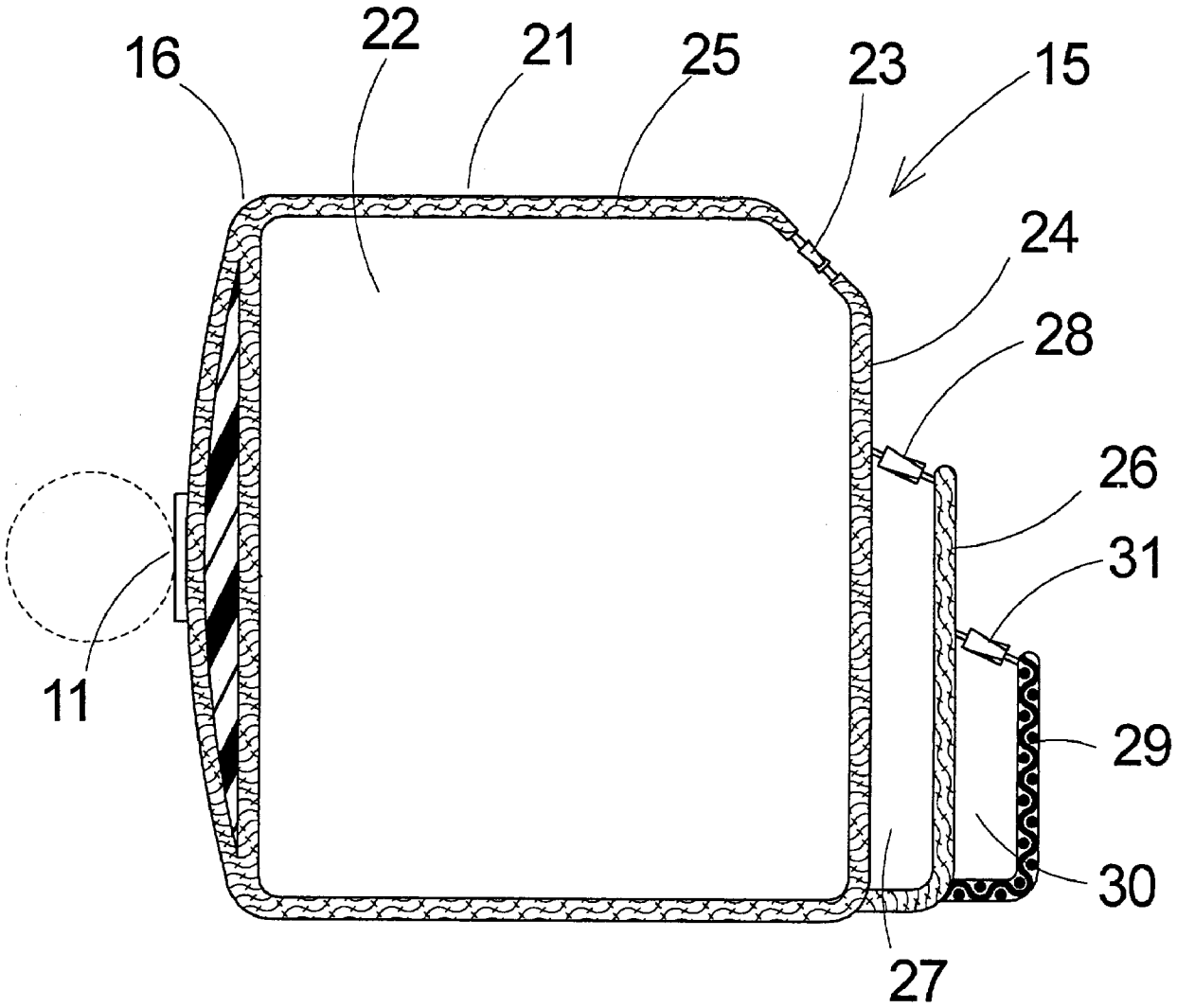
FIG. 3 is a cross-sectional view of the present invention taken along line 3—3 of FIG. 1.
Figure 4:
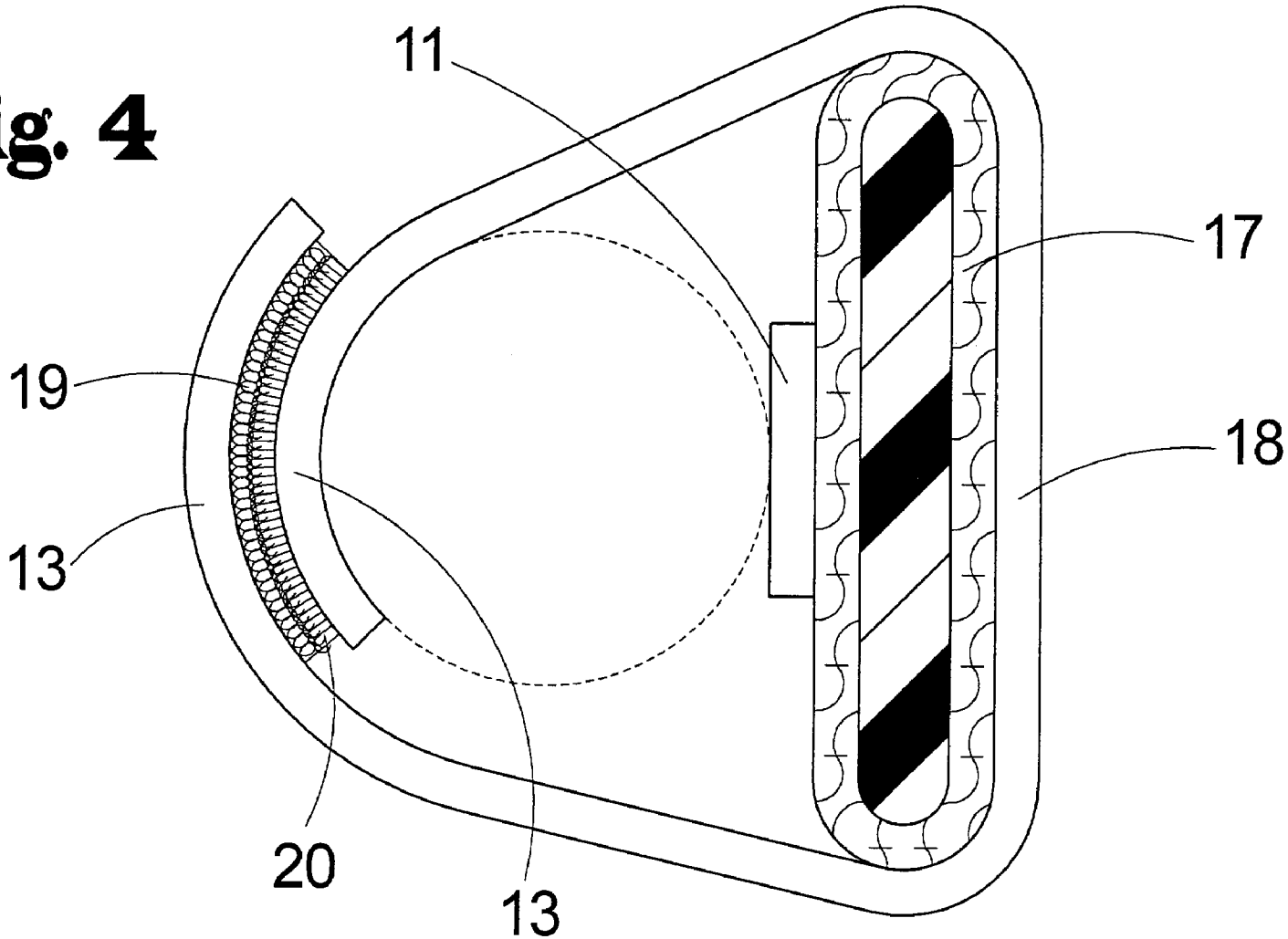
FIG. 4 is a cross-sectional view of the present invention taken along line 4—4 of FIG. 1.

With reference now to the drawings, and in particular to FIGS. 1 through 4 thereof, a new the carrier device embodying the principles and concepts of the present invention and generally designated by the reference numeral 10 will be described.

As best illustrated in FIGS. 1 through 4, the the carrier device 10 generally comprises a strap member 11 being designed for being selectively coupled to the walker. The strap member 11 is designed for being positioned around a user when the strap member 11 is removed from the walker. A clip member 12 is coupled to one of a pair of free ends 13 of the strap member 11. A receiver member 14 is coupled to the other one of the free ends 13 of the strap member 11. The receiver member 14 selectively receives the clip member 12 to secure the strap member 11 to the walker.

A receiving assembly 15 is coupled to the strap member 11 whereby the strap member 11 is designed for coupling the receiving assembly 15 to the walker. The receiving assembly 15 is designed for receiving objects to be carried for the user whereby the receiving assembly 15 is for allowing the hands of the user to be used on the walker to enhance the safety of the user using the walker.

The receiving assembly 15 comprises a container member 16. The container member 16 is coupled to the strap member 11 whereby the container member 16 is designed for being positioned on a front of the walker when the strap member 11 is coupled to opposing front stanchions of the walker. The container member 16 is designed for receiving objects to be carried for the user of the walker.

The receiving assembly 15 comprises a plurality of reinforcement members 17. Each of the reinforcement members 17 is oppositely coupled to the container member 16 and the strap member 11. Each of the reinforcement members 17 is for transferring force from the strap member 11 over a greater area to inhibit the container member 16 being damaged when the strap member 11 is stretched tightly between the front stanchions of the walker. Each of the reinforcement members 17 tapers from the container member 16 of the receiving assembly 15 to the strap member 11 to distribute force from the strap member 11 over a greater area of the container member 16.

The receiving assembly 15 comprises a plurality of securing straps 18. Each of the securing straps 18 is coupled to one of the reinforcement members 17. Each of the securing straps 18 is designed for engaging a support bar of the walker whereby the securing straps 18 are for securing the container member 16 to the support bar to inhibit movement of the container member 16 when the user is using the walker.

Each the securing straps 18 comprises a first fastener member 19 and a second fastener member 20. The first fastener member 19 is coupled to one of a pair of ends of the associated one of the strap member 11*s*. The second fastener member 20 is coupled to an opposing one of the ends of the associated one of the strap member 11*s* whereby the first fastener member 19 is complimentary to the second fastener member 20 for securing the associated one of the securing straps 18 around the support bar of the walker.

The container member 16 of the receiving assembly 15 comprises a perimeter wall 21. The perimeter wall 21 defines an interior space 22 of the container member 16. The interior space 22 of the container member 16 is designed for receiving the objects to be carried for the user.

The container member 16 comprises a first zipper assembly 23. The first zipper assembly 23 is coupled between a front wall 24 of the perimeter wall 21 of the container member 16 and a side wall 25 of the perimeter wall 21 of the container member 16. The first zipper assembly 23 is for selectively permitting separation of the front wall 24 from the side wall 25 to permit access to the interior space 22 of the container member 16 when the first zipper assembly 23 is actuated by the user.

The container member 16 comprises a pocket wall 26. The pocket wall 26 is coupled to the perimeter wall 21 of the container member 16 whereby the pocket wall 26 defines a pocket space 27 between the perimeter wall 21 and the pocket wall 26. The pocket space 27 of the container member 16 is designed for receiving objects to be carried by the container member 16 when the user is using the walker.

The container member 16 comprises a second zipper assembly 28. The second zipper assembly 28 is coupled between the pocket wall 26 and the perimeter wall 21. The second zipper assembly 28 is for selectively permitting access to the pocket space 27 of the container member 16 when the second zipper assembly 28 is actuated by the user.

The container member 16 comprises a storage wall 29. The storage wall 29 is coupled to the pocket wall 26 whereby the storage wall 29 defines a storage space 30 between the storage wall 29 and the pocket wall 26. The storage space 30 is designed for receiving articles to be carried by the container member 16 when the user is using the walker. The storage wall 29 of the container member 16 comprises a mesh material. The mesh material is designed for permitting the user to view the articles positioned in the storage space 30 of the container member 16.

The container member 16 comprises a third zipper assembly 31. The third zipper assembly 31 is coupled between the storage wall 29 and the pocket wall 26. The third zipper assembly 31 is for selectively permitting access to the storage space 30 of the container member 16 when the third zipper assembly 31 is actuated by the user.

At least one beverage member 32 is coupled to the receiving assembly 15. The beverage member 32 is designed for receiving a beverage container whereby the beverage member 32 is for supporting the beverage container when the user is using the walker. The beverage member 32 comprises a peripheral wall 33. The peripheral wall 33 of the beverage member 32 defines a receiving space 34 whereby the receiving space 34 is designed for receiving the beverage container.

The beverage member 32 comprises a drawstring member 35. The drawstring member 35 is coupled to an upper end of the peripheral wall 33 of the beverage member 32. The drawstring member 35 is designed for drawing the upper end of the peripheral wall 33 around the beverage container when the drawstring is pulled by the user.

A batting material may positioned within a rear wall of the perimeter wall 21 of the container member 16, each of the reinforcement members 17 and the peripheral wall 33 of the beverage member 32. The batting material in the rear wall of the container member 16 and the reinforcement members 17 is for providing padding to inhibit damage occurring to the objects positioned in the container member 16. The batting material in the peripheral wall 33 of the beverage member 32 provides insulation for the beverage container received by the beverage member 32.

In use, the user extends the strap member 11 around the front stanchions of the walker and secures the slip member to the receiver member 14. The user can then access the interior space 22, the pocket space 27 and the storage space 30 of the container member 16 to store and retrieve objects. The user can place the beverage container into the beverage member 32 and draw the drawstring member 35 to tighten the beverage member 32 around the beverage container to inhibit the beverage container from inadvertently falling out of the beverage member 32. By placing objects to be carried in the container member 16 the hands of the user are left free to work the walker without concern of dropping the objects.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A carrier device for coupling to a walker to allow a user to carry items when the user is using the walker, the carrier device comprising:

a strap member being adapted for being selectively coupled to the walker, said strap member being adapted for being positioned around a user when said strap member is removed from the walker;

a receiving assembly being coupled to said strap member such that said strap member is adapted for coupling said receiving assembly to the walker, said receiving assembly being adapted for receiving objects to be carried for the user such that said receiving assembly is for allowing the hands of the user to be used on the walker to enhance the safety of the user using the walker;

said receiving assembly comprising a container member, said container member being coupled to said strap member such that said container member is adapted for being positioned on a front of the walker when said strap member is coupled to opposing front stanchions of the walker, said container member being adapted for receiving objects to be carried for the user of the walker;

said receiving assembly comprising a plurality of reinforcement members, each of said reinforcement members being oppositely coupled to said container member and said strap member, each of said reinforcement members being for transferring force from said strap member over a greater area to inhibit said container member being damaged when said strap member is stretched tightly between the front stanchions of the walker; and said receiving assembly comprising a plurality of securing straps, each of said securing straps being coupled to one of said reinforcement members, each of said securing straps being adapted for engaging a support bar of the walker such that said securing straps are for securing said container member to the support bar to inhibit movement of said container member when the user is using the walker.

2. The carrier device as set forth in claim 1, further comprising:

each of said reinforcement members tapering from said container member of said receiving assembly to said strap member to distribute force from said strap member over a greater area of said container member.

3. The carrier device as set forth in claim 1, further comprising:

each said securing straps comprising a first fastener member and a second fastener member, said first fastener member being coupled to one of a pair of ends of the associated one of said strap members, said second fastener member being coupled to an opposing one of said ends of the associated one of said strap members such that said first fastener member is complimentary to said second fastener member for securing the associated one of said securing straps around the support bar of the walker.

4. The carrier device as set forth in claim 1, further comprising:

a clip member being coupled to one of a pair of free ends of said strap member, a receiver member being coupled to the other one of said free ends of said strap member, said receiver member selectively receiving said clip member to secure said strap member to the walker.

5. The carrier device as set forth in claim 1, further comprising:

at least one beverage member being coupled to said receiving assembly, said beverage member being adapted for receiving a beverage container such that said beverage member is for supporting the beverage container when the user is using the walker.

6. The carrier device as set forth in claim 5, further comprising:

said beverage member comprising a peripheral wall, said peripheral wall of said beverage member defining a receiving space such that said receiving space is adapted for receiving the beverage container.

7. The carrier device as set forth in claim 6, further comprising:

said beverage member comprises a drawstring member, said drawstring member being coupled to an upper end of said peripheral wall of said beverage member, said drawstring member being adapted for drawing said upper end of said peripheral wall around the beverage container when said drawstring is pulled by the user.

8. The carrier device as set forth in claim 1, further comprising:

said container member of said receiving assembly comprising a perimeter wall, said perimeter wall defining an interior space of said container member, said interior space of said container member being adapted for receiving the objects to be carried for the user.

9. The carrier device as set forth in claim 8, further comprising:

said container member comprising a first zipper assembly, said first zipper assembly being coupled between a front wall of said perimeter wall of said container member and a side wall of said perimeter wall of said container member, said first zipper assembly being for selectively permitting separation of said front wall from said side wall to permit access to said interior space of said container member when said first zipper assembly is actuated by the user.

10. The carrier device as set forth in claim 8, further comprising:

said container member comprising a pocket wall, said pocket wall being coupled to said perimeter wall of said container member such that said pocket wall defines a pocket space between said perimeter wall and said pocket wall, said pocket space of said container member being adapted for receiving objects to be carried by said container member when the user is using the walker.

11. The carrier device as set forth in claim 10, further comprising:

said container member comprising a second zipper assembly, said second zipper assembly being coupled between said pocket wall and said perimeter wall, said second zipper assembly being for selectively permitting access to said pocket space of said container member when said second zipper assembly is actuated by the user.

12. The carrier device as set forth in claim 10, further comprising:

said container member comprising a storage wall, said storage wall being coupled to said pocket wall such that said storage wall defines a storage space between said storage wall and said pocket wall, said storage space being adapted for receiving articles to be carried by said container member when the user is using the walker.

13. The carrier device as set forth in claim 12, further comprising:

said container member comprising a third zipper assembly, said third zipper assembly being coupled between said storage wall and said pocket wall, said third zipper assembly being for selectively permitting access to said storage space of said container member when said third zipper assembly is actuated by the user.

14. The carrier device as set forth in claim 12, further comprising:

said storage wall of said container member comprising a mesh material, said mesh material being adapted for permitting the user to view the articles positioned in said storage space of said container member.

15. A carrier device for coupling to a walker to allow a user to carry items when the user is using the walker, the carrier device comprising:

a strap member being adapted for being selectively coupled to the walker, said strap member being adapted for being positioned around a user when said strap member is removed from the walker;

a receiving assembly being coupled to said strap member such that said strap member is adapted for coupling said receiving assembly to the walker, said receiving assembly being adapted for receiving objects to be carried for the user such that said receiving assembly is for allowing the hands of the user to be used on the walker to enhance the safety of the user using the walker;

said receiving assembly comprising a container member, said container member being coupled to said strap member such that said container member is adapted for being positioned on a front of the walker when said strap member is coupled to opposing front stanchions of the walker, said container member being adapted for receiving objects to be carried for the user of the walker;

said receiving assembly comprising a plurality of reinforcement members, each of said reinforcement members being oppositely coupled to said container member and said strap member, each of said reinforcement members being for transferring force from said strap member over a greater area to inhibit said container member being damaged when said strap member is stretched tightly between the front stanchions of the walker;

each of said reinforcement members tapering from said container member of said receiving assembly to said strap member to distribute force from said strap member over a greater area of said container member;

said receiving assembly comprising a plurality of securing straps, each of said securing straps being coupled to one of said reinforcement members, each of said securing straps being adapted for engaging a support bar of the walker such that said securing straps are for securing said container member to the support bar to inhibit movement of said container member when the user is using the walker;

each said securing straps comprising a first fastener member and a second fastener member, said first fastener member being coupled to one of a pair of ends of the associated one of said strap members, said second fastener member being coupled to an opposing one of said ends of the associated one of said strap members such that said first fastener member is complimentary to said second fastener member for securing the associated one of said securing straps around the support bar of the walker;

said container member of said receiving assembly comprising a perimeter wall, said perimeter wall defining an interior space of said container member, said interior space of said container member being adapted for receiving the objects to be carried for the user;

said container member comprising a first zipper assembly, said first zipper assembly being coupled between a front wall of said perimeter wall of said container member and a side wall of said perimeter wall of said container member, said first zipper assembly being for selectively permitting separation of said front wall from said side wall to permit access to said interior space of said container member when said first zipper assembly is actuated by the user;

said container member comprising a pocket wall, said pocket wall being coupled to said perimeter wall of said container member such that said pocket wall defines a pocket space between said perimeter wall and said pocket wall, said pocket space of said container member being adapted for receiving objects to be carried by said container member when the user is using the walker;

said container member comprising a second zipper assembly, said second zipper assembly being coupled between said pocket wall and said perimeter wall, said second zipper assembly being for selectively permitting access to said pocket space of said container member when said second zipper assembly is actuated by the user;

said container member comprising a storage wall, said storage wall being coupled to said pocket wall such that said storage wall defines a storage space between said storage wall and said pocket wall, said storage space being adapted for receiving articles to be carried by said container member when the user is using the walker;

said container member comprising a third zipper assembly, said third zipper assembly being coupled between said storage wall and said pocket wall, said third zipper assembly being for selectively permitting access to said storage space of said container member when said third zipper assembly is actuated by the user;

said storage wall of said container member comprising a mesh material, said mesh material being adapted for permitting the user to view the articles positioned in said storage space of said container member;

at least one beverage member being coupled to said receiving assembly, said beverage member being adapted for receiving a beverage container such that said beverage member is for supporting the beverage container when the user is using the walker;

said beverage member comprising a peripheral wall, said peripheral wall of said beverage member defining a receiving space such that said receiving space is adapted for receiving the beverage container;

said beverage member comprises a drawstring member, said drawstring member being coupled to an upper end of said peripheral wall of said beverage member, said drawstring member being adapted for drawing said upper end of said peripheral wall around the beverage container when said drawstring is pulled by the user; and a clip member being coupled to one of a pair of free ends of said strap member, a receiver member being coupled to the other one of said free ends of said strap member, said receiver member selectively receiving said clip member to secure said strap member to the walker.

* * * * *